US008375500B1

(12) United States Patent
Aguirre

(10) Patent No.: US 8,375,500 B1
(45) Date of Patent: Feb. 19, 2013

(54) WINDOW MAINTENANCE DEVICE FOR LARGE VEHICLES

(76) Inventor: Michael K. Aguirre, Pueblo, CO (US)

( * ) Notice: Subject to any disclaimer, the term of this patent is extended or adjusted under 35 U.S.C. 154(b) by 0 days.

(21) Appl. No.: 13/278,675

(22) Filed: Oct. 21, 2011

(51) Int. Cl.
*A46B 5/02* (2006.01)

(52) U.S. Cl. ..... 15/144.1; 15/121; 15/144.4; 15/245

(58) Field of Classification Search ..... 15/144.1; 134/6
See application file for complete search history.

(56) References Cited

U.S. PATENT DOCUMENTS

| | | | | |
|---|---|---|---|---|
| 3,036,322 | A | 5/1962 | Jorgensen | |
| 3,968,535 | A | 7/1976 | Nichols, Jr. | |
| 4,041,564 | A | 8/1977 | Schlichter | |
| 4,809,386 | A | 3/1989 | Re | |
| 5,951,078 | A | 9/1999 | Whitehead et al. | |
| 7,155,770 | B2 | 1/2007 | Anderson et al. | |
| 7,533,436 | B2 | 5/2009 | Vaartjes et al. | |
| 7,617,560 | B2 * | 11/2009 | Argo et al. | 15/245 |
| 2003/0150478 | A1 * | 8/2003 | Biggs | 134/6 |
| 2010/0186183 | A1 | 7/2010 | Weinberger et al. | |
| 2011/0056035 | A1 * | 3/2011 | Burbacki | 15/144.1 |

* cited by examiner

*Primary Examiner* — Monica Carter
*Assistant Examiner* — Stephanie N Berry
(74) *Attorney, Agent, or Firm* — Montgomery Patent & Design; Robert C Montgomery

(57) ABSTRACT

A windshield maintenance assembly having a telescoping pole assembly that is selectively extendable and retractable. An upper end of the windshield maintenance assembly preferably includes a reversible snow brush and an ice scraper. The windshield maintenance assembly further includes a long strap that is attached at the top of the windshield maintenance assembly which allows a user to pull down or pull back on the upper end to increase operating forces. The windshield maintenance assembly beneficially enables a plurality of attachable heads, such as a squeegee, a broom, or a sponge, to be attached to the upper end to enable other maintenance functions.

16 Claims, 12 Drawing Sheets

WINDOW MAINTENANCE DEVICE FOR LARGE VEHICLES

RELATED APPLICATIONS

There are no current co-pending applications.

FIELD OF THE INVENTION

The present invention relates generally to a cleaning apparatus for vehicles, and in particular, to an extensible pole and a plurality of attachments particularly adapted for use cleaning large vehicles such as tractor trailers.

BACKGROUND OF THE INVENTION

Maintaining a clean automobile windshield is a necessary step in ensuring driving safety. The most common tool available to perform this task is the simple ice scraper and snow brush combination. Proper use of such a tool keeps wintertime driving safe for everyone.

Such tools are capable of removing large quantities of snow and ice in order to ensure that the windshield, other windows and even large body areas are free of snow and ice prior to driving a vehicle. However, such devices are not particularly effective and their use quickly becomes limited in conjunction with a large vehicle. This is generally true of any vehicle with a windshield far off of the ground such as a tractor trailer rig, snow plow, bus, or even large SUV's.

While some long-handled variants of brushes or scrapers are available, these objects are cumbersome to transport. Furthermore, it is extremely difficult to apply adequate downward pressure to dislodge ice from a windshield when attempting to utilize a long pole to reach the windshield.

Various attempts have been made to provide brush or ice scraper tools that can be utilized for various cleaning purposes. Examples of these attempts can be seen by reference to several U.S. patents, including U.S. Pat. No. 3,036,322; U.S. Pat. No. 3,968,535; U.S. Pat. No. 4,041,564; U.S. Pat. No. 4,809,386; U.S. Pat. No. 5,951,078; U.S. Pat. No. 7,155,770; and U.S. Pat. No. 7,533,436. However, none of these designs are similar to the present invention.

While these apparatuses fulfill their respective, particular objectives, each of these references suffer from one or more disadvantages. Many such apparatuses do not provide a range of functionality desirable for large vehicles. Many such apparatuses are limited in their range of adjustment. Many such apparatuses do not address the issue of providing torque against the vehicle with a long-handled cleaning implement in order to successfully remove ice and other debris. Accordingly, there exists a need for a means by which ice and snow can be removed from large vehicles to ensure safe wintertime driving without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a long-handled, adjustable implement particularly adapted to provide a range of cleaning functions to a large vehicle and to enable a user to successfully manipulate the apparatus while it is extended. Thus, the object of the present invention is to solve the aforementioned disadvantages and provide for this need.

To achieve the above objectives, it is an object of the present invention to provide a means for removing ice, snow or similar debris from a large vehicle such as a tractor trailer cab, a heavy equipment vehicle, or the like. The apparatus comprises an extension pole with a plurality of attachments designed to enable a user to remove debris from a vehicle which is otherwise too large for the user to adequately clean.

Another object of the present invention is to be variably extensible to reach various high areas on large vehicles when extended and for ease of manipulation, transport, or storage while collapsed. The apparatus includes a second extension handle telescopingly engaged within a first extension handle to provide the adjustment and a detent pin locking mechanism.

Yet still another object of the present invention is to provide a pivoting member at a distal end of the second extension handle enabling selective angular adjustment of an attachment on the apparatus in order to enable a user to adjust the configuration of the apparatus based upon a particular task, vehicle size and shape, and user preferences. The pivoting member further includes a locking mechanism.

Yet still another object of the present invention is to comprise an attachment extension thread at a distal end of the second extension handle for securely removably receiving one (1) of a plurality of attachments.

Yet still another object of the present invention is to comprise the distal end of the second extension handle of a ring stop that enables placement of a torque member. The torque member comprises a ring attached to the ring stop and a strap that enables a user to provide additional downward torque to the apparatus during use.

Yet still another object of the present invention is to comprise a first pivoting attachment which provides additional length to the apparatus when attached to the attachment extension thread. The first pivoting attachment further includes a similar pivoting attachment and a similar thread as the second extension handle for attachment of other attachments.

Yet still another object of the present invention is to comprise a plurality of attachments each having an attachment threaded portion for attachment to the second extension handle or the first pivoting attachment.

Yet still another object of the present invention is to comprise a first attachment having a triangular body and a plurality of bristles and particularly adapted for brushing away debris from the surface of a tractor trailer cab.

Yet still another object of the present invention is to comprise a second attachment having a generally cylindrical pad body fabricated from a sponge material with a mesh overlay and particularly adapted for scrubbing and cleaning a vehicle exterior. The second attachment further includes a squeegee integrally molded to the attachment threaded portion.

Yet still another object of the present invention is to comprise a third attachment comprise a scraper head and particularly adapted to scrape ice and similar debris from a vehicle. The third attachment has a widened portion that provides support to inhibit the attachment from rolling over during use.

Yet still another object of the present invention is to provide a storage bag designed to store and protect the apparatus, including the plurality of attachments, during periods of non-use.

Yet still another object of the present invention is to provide a method of utilizing the device that provides a unique means of grasping the extension pole, pivoting the pivoting member to a desired angle, attaching a desired head attachment onto the second attachment extension, utilizing the first attachment to brush the vehicle, utilizing the second attachment to wash or squeegee the vehicle, or utilizing the third attachment to scrape the vehicle, extending the second handle extension away from the first handle extension as desired by engaging the handle extension detent pin, removing debris from the desired vehicle via the sliding or scraping the head attachment onto said vehicle and grasping the 43 of the torque member to provide additional torque while removing debris, and, removing ice and snow from large vehicles in a manner which is quick, easy, and effective.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
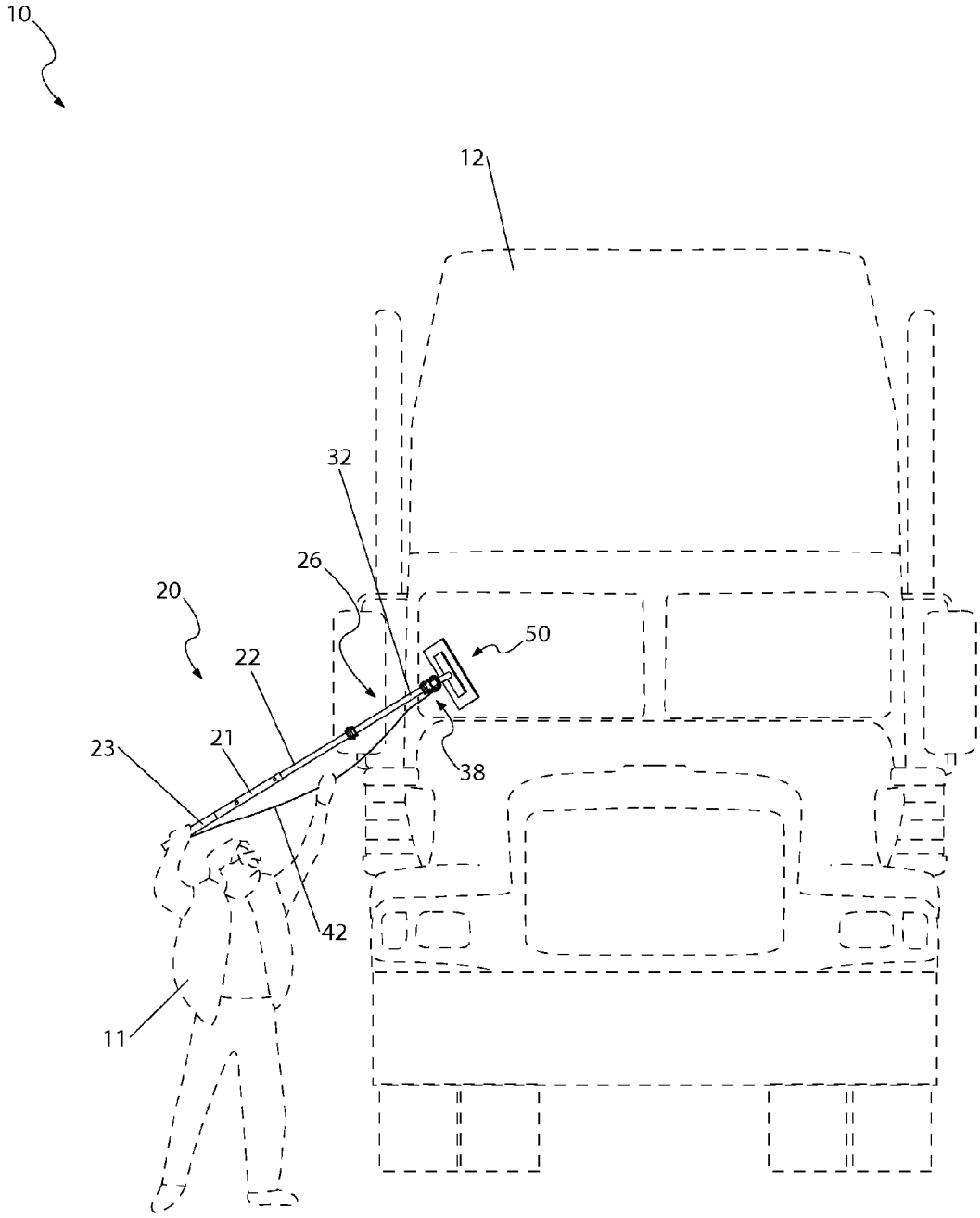
FIG. 1 is an environmental view of a window maintenance device 10 that is in accord with the principles of the present invention being used by a user 11 to clean a windshield of a tractor trailer 12.

| DESCRIPTIVE KEY | |
|---|---|
| 10 | window maintenance device |
| 11 | user |
| 12 | tractor trailer |
| 20 | pole assembly |
| 21 | first handle extension |
| 22 | second handle extension |
| 23 | handle grip |
| 24 | handle extension detent pin |
| 25 | handle extension aperture |
| 26 | first pivoting member |

-continued

| DESCRIPTIVE KEY | |
|---|---|
| 27 | handle extension fork |
| 28 | axle |
| 29 | axle protrusion |
| 30 | fork aperture |
| 31 | fork protrusion |
| 32 | first attachment extension |
| 33 | ring stop |
| 36 | second attachment extension |
| 37 | attachment extension fork |
| 38 | second pivoting member |
| 39 | attachment extension threads |
| 40 | torque member |
| 41 | ring |
| 42 | strap |
| 43 | loop |
| 50 | head attachment |
| 51 | first attachment |
| 52 | triangular body |
| 53 | bristles |
| 54 | first attachment extension member |
| 55 | second attachment |
| 56 | attachment panel |
| 57 | pad body |
| 58 | second attachment extension member |
| 59 | squeegee |
| 60 | third attachment |
| 61 | scraper body |
| 62 | scraping blade |
| 63 | third attachment extension member |
| 65 | attachment threaded portion |
| 70 | storage bag |
| 71 | interior surface |
| 72 | drawstring |
| 73 | top |
| 74 | bottom |

DETAILED DESCRIPTION OF THE PREFERRED EMBODIMENT

The best mode for carrying out the invention is presented in terms of its preferred embodiment, herein depicted within FIGS. 1 through 13. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Specifically, the principles of the present invention provide for a window maintenance device 10 that has a telescoping pole assembly 20 that is selectively extendable and retractable. An upper end of the window maintenance device 10 includes features that enable the attachment of a snow brush, an ice scraper, or another cleaning tool such as a cleaning brush, a squeegee, or another maintenance tool. The window maintenance device 10 further includes a long torque member 40 that allows a user 11 to pull down or pull back on the upper end to increase operating forces.

FIG. 1 presents an environmental view of a window maintenance device 10 that is in accord with the principles of the present invention. The window maintenance device 10 is an elongated assembly suitable for removing ice, snow, mud, dirt, or similar debris from windows of large vehicles, such as a tractor trailer 12 as shown in FIG. 1. In operation the window maintenance device 10 includes a telescoping pole assembly 20 that extends to a desired length and includes an attachment suitable for enabling a user 11 to remove debris from the window of a vehicle such as the tractor trailer 12. The window maintenance device 10 is particularly useful when the vehicle is too large or tall for the user 11 to adequately clean.

Figure 2:
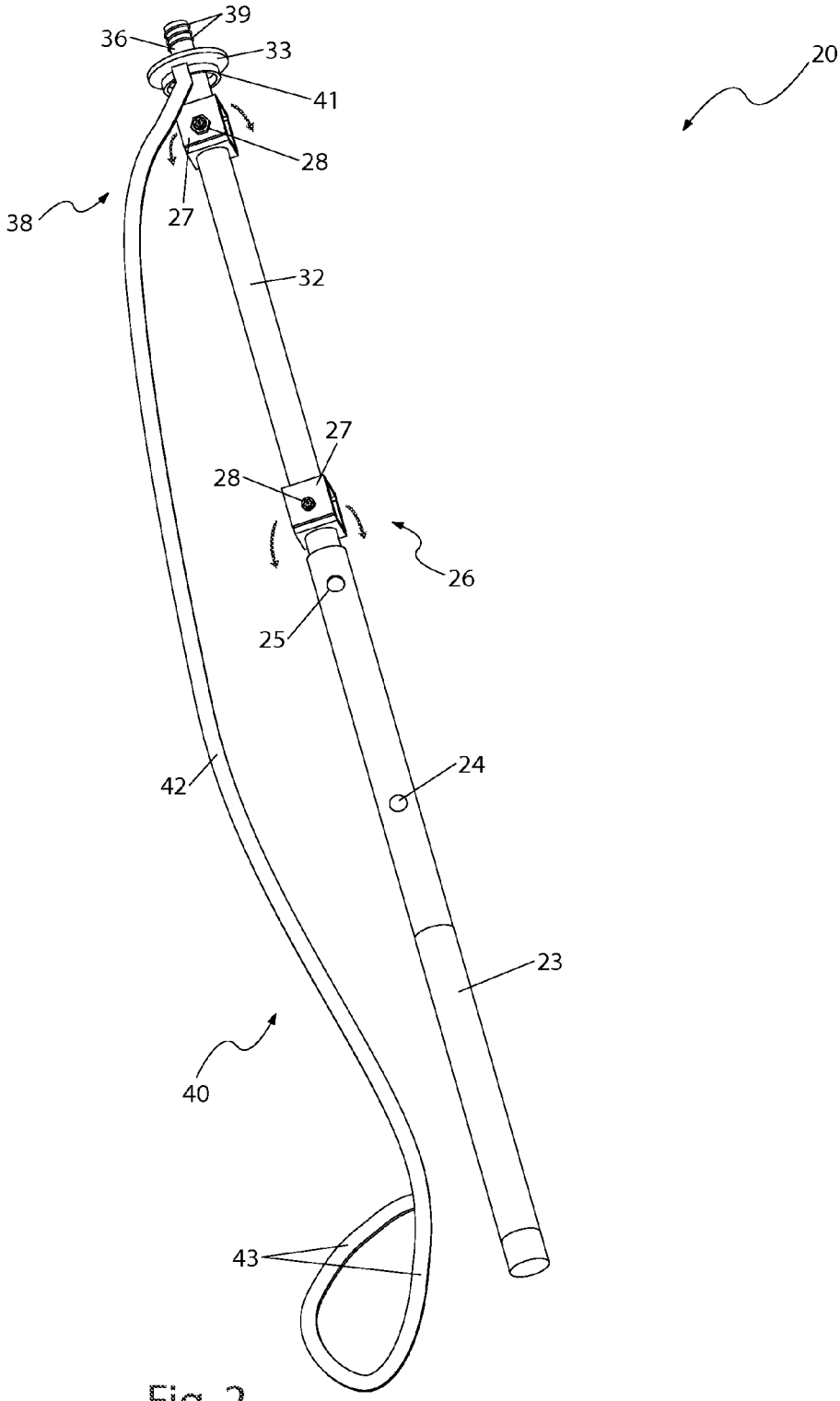
FIG. 2 is a perspective view of pole assembly 20 of the window maintenance device 10 illustrated in FIG. 1 when the pole assembly 20 is in a collapsed state.
Figure 3:
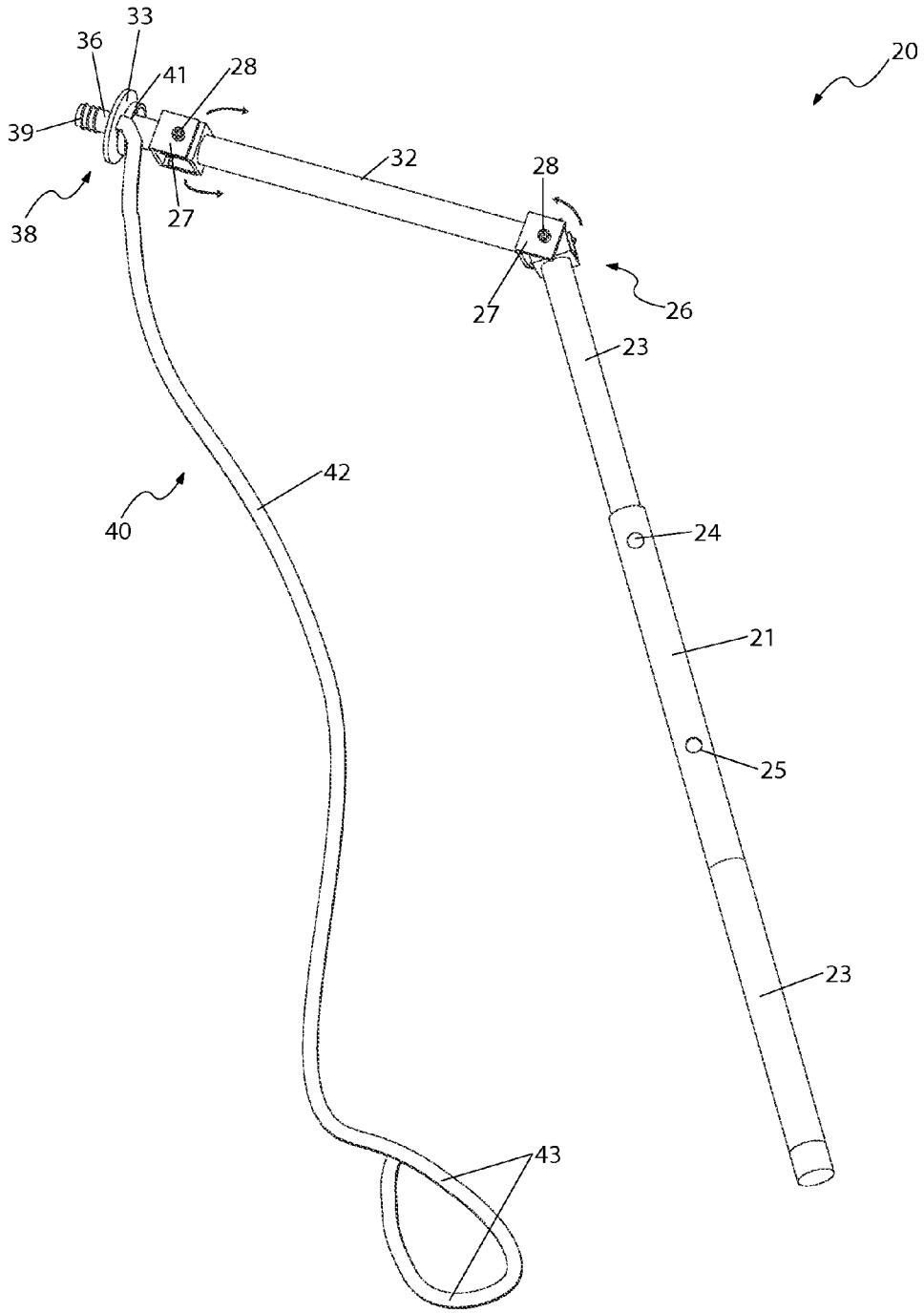
FIG. 3 is a side view of the pole assembly 20 illustrated in FIG. 2 when it is in an elongated state.

FIG. 2 is a perspective view of the pole assembly 20 when it is in its collapsed state while FIG. 3, a perspective view of the pole assembly 20 when it is in its elongated state. The pole assembly 20 has an adjustable length that enables the user 11 to set the length to comfortably reach a desired surface. In practice the pole assembly 20 will span lengths from approximately four (4) feet to about eight (8) foot six (6) inches, and will preferably be fabricated from thin-walled steel tubing, aluminum tubing, plastic tubing, or the like.

As shown in FIGS. 1, 2, and 3 the pole assembly 20 includes a tubular first handle extension 21, and as shown in FIGS. 1 and 3, a tubular second handle extension 22. In practice the first handle extension 21 and the second handle extension 22 enable the upright length of the pole assembly 20 to extend from about four (4) feet to about seven (7) feet. The second handle extension 22 has an outer diameter that is slightly less than the inner diameter of the first handle extension 21. This enables the second handle extension 22 to slide within the first handle extension 21. As shown in FIGS. 1, 2, and 3 a proximal exterior surface of the first handle extension 21 comprises a handle grip 23 which provides a slip-resistant grip for the user 11. The handle grip 23 is beneficially comprised of rubber, polyurethane, or a similar slip-resistant coating.

Referring now primarily to FIG. 3, the second handle extension 22 can be locked into a desired position within the first handle extension 21 by aligning a handle extension detent pin 24 that is located on an exterior surface of the second handle extension 22 with one of a plurality of handle extension apertures 25 that pass through the first handle extension 21. The handle extension detent pin 24 is a spring loaded detent that engages with the desired handle extension aperture 25 and prohibits movement of the second handle extension 22 within the first handle extension 21.

Figure 5:
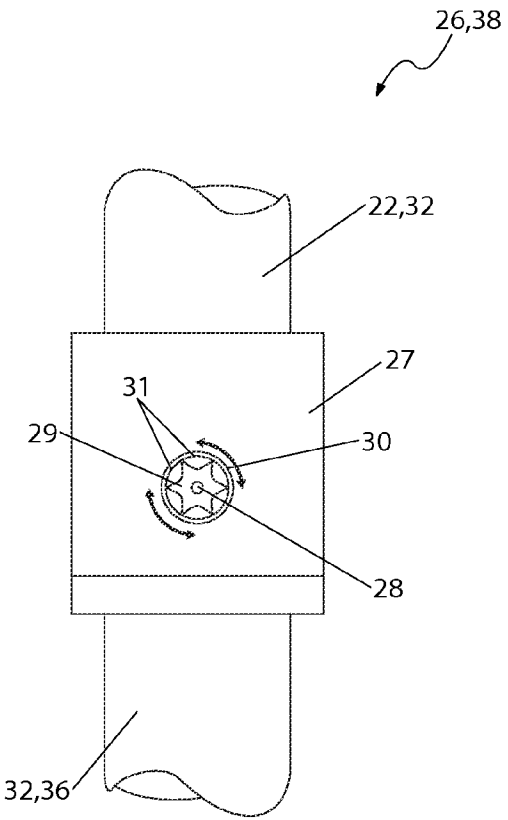
FIG. 5 is a side view of the pivoting member 26, 38 illustrated in FIG. 4.
Figure 4:
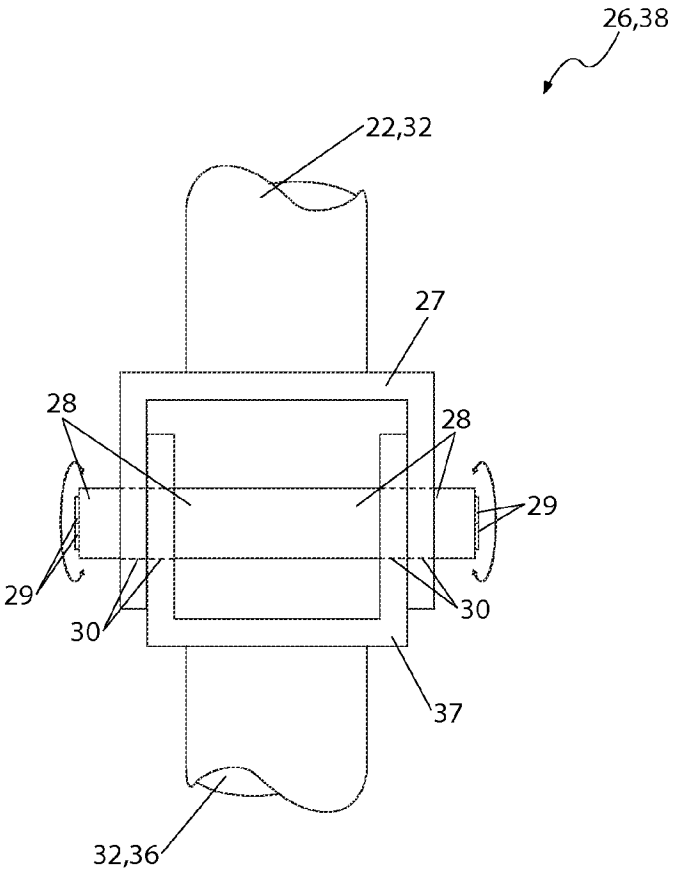
FIG. 4 is a front view of a pivoting member 26, 38 of the pole assembly 20 illustrated in FIG. 2.

Referring now primarily to FIGS. 3, 4, and 5 (also reference FIG. 1), at a distal portion of the second handle extension 22 is a first pivoting member 26. The first pivoting member 26 both couples an attachment, represented in FIGS. 1, 3, 4, and 5 by the first attachment extension 32, to the second handle extension 22 and enable pivoting of that attachment over a range of one-hundred-and-eighty (180°) degrees. The first pivoting member 26 further enables locking the attachment at desired angles, which is preferably includes at least five (5°) degrees, twenty (20°) degrees, and thirty (30°) degrees.

Still referring primarily to FIGS. 3, 4, and 5 the end of the first attachment extension 32 that is opposite the first pivoting member 26 is attached to a second pivoting member 38 which enables rotation of a head attachment 50 (see FIG. 1). The first attachment extension 32 extends the window maintenance device 10 up to an additional eighteen (18) inches. The second pivoting member 38 is similar to or identical with the first pivoting attachment 26.

Still referring primarily to FIGS. 3, 4, and 5, extending from the second pivoting member 38 is a second attachment extension 36, which is beneficially a one (1) inch integrally molded piece. The second pivoting member 38 enables the second attachment extension 36 to pivot one-hundred-and-eighty (180°) degrees relative to the first attachment extension 32 and to be selectively locked at a selected angle, which preferably can be at least five (5°) degrees, twenty (20°) degrees, or thirty (30°) degrees. The end of the second attachment extension 36 opposite the second pivoting member 38 has attachment extension threads 39 which enable attachment of a desired head attachment 50. The first attachment extension 32 and second attachment extension 36 are beneficially tubular poles that assist the user 11 to reach the desired surface.

As shown in FIGS. 2 and 3, at an exterior proximal surface of the second attachment extension 36 is an integrally molded ring stop 33. The ring stop 33 enables placement and securing of a torque member 40 (see FIGS. 2, 3, and 6). The torque member 40 enables the user 11 to apply additional torque to the window maintenance device 10 to assist removal of debris from the tractor trailer 12 (see FIG. 1) or similar vehicle. At one (1) end of the torque member 40 is a ring 41 that in a fully assembled window maintenance device 10 is positioned between the second attachment extension 36 and the second pivoting member 38.

Referring now to FIG. 4, a front view of either the first pivoting member 26 or the second pivoting member 38, and FIG. 5, a side view of the first pivoting member 26 or the second pivoting member 38, each pivoting member 26, 38 has a handle extension fork 27 and an attachment extension fork 37 which are axially attached to enable pivoting of either the first attachment extension 32 or the second attachment extension 36. The handle extension fork 27 is integrally molded to a distal surface of the second handle extension 22 or the first attachment extension 32, and the attachment extension fork 37 is integrally molded to a proximal surface of the first attachment extension 32 or the second attachment extension 36. Each extension fork 27, 37 has a fork aperture 30 which aligns to a position on an axle 28 (also see FIGS. 2 and 3). The fork apertures 30 have a plurality of radially spaced fork protrusions 31 which engage a plurality of axle protrusions 29 which are radially spaced upon the axle 28. The engaging of the axle protrusions 29 to the fork protrusions 31 provides a locking feature to the pivoting members 26, 38 which further secure the window maintenance device 10 at a desired angle.

Figure 6:
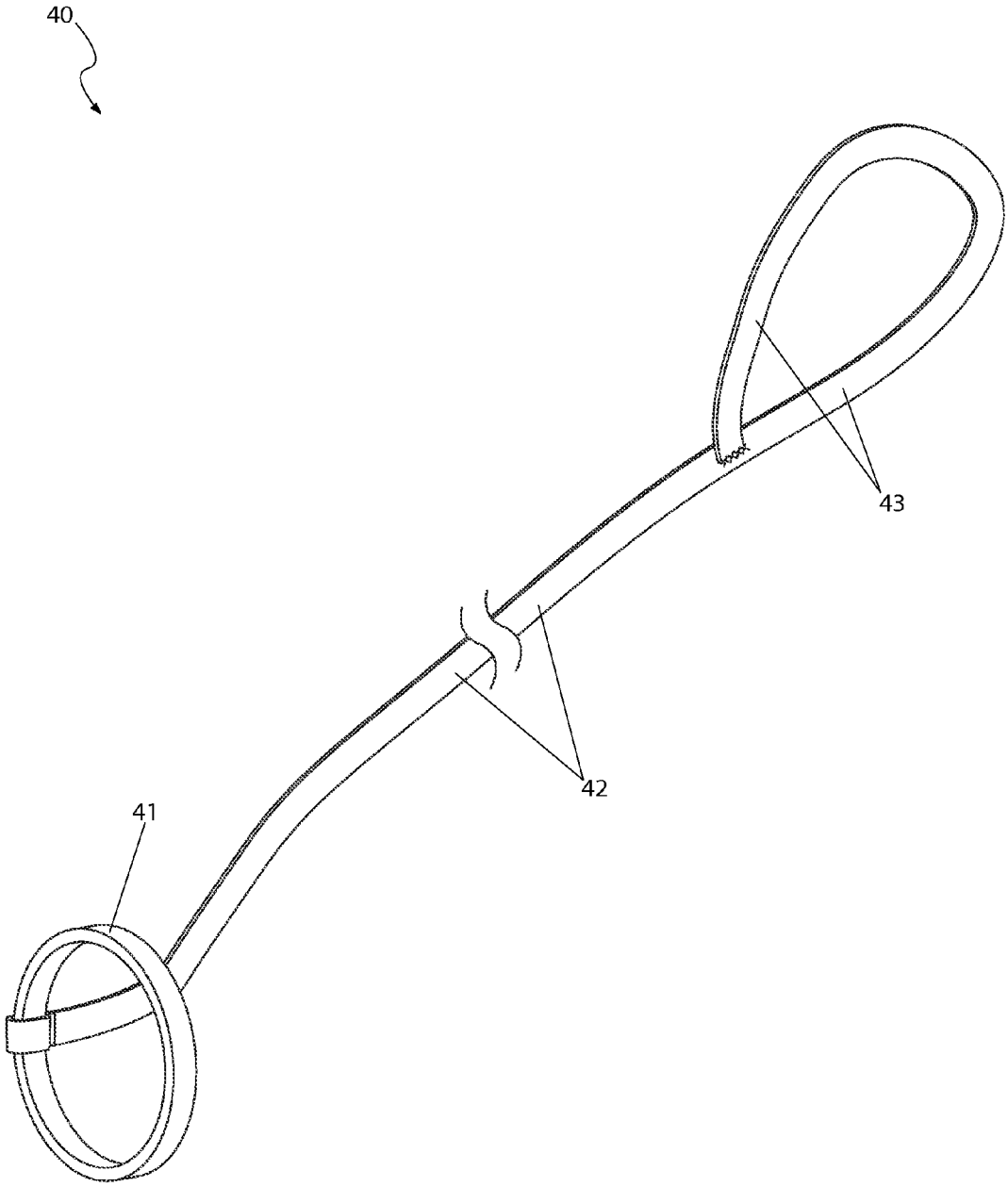
FIG. 6 is a perspective view of a torque member 40 of the window maintenance device 10 illustrated in FIG. 1.

Referring now to FIG. 6 for a depiction of the torque member 40. The window maintenance device 10 includes the torque member 40 to enable the user 11 to provide additional downward torque to the window maintenance device 10 during use. The torque member 40 has a ring 41 and a strap 42. The torque member 40 is attached to the first attachment extension 32 subjacent to the ring stop 33. The ring 41 is beneficially fabricated from materials such as aluminum or the like and has a diameter that is slightly larger than the exterior diameter of the first attachment extension 32 and slightly smaller than the diameter of the ring stop 33. This enables the ring 41 to be secured. The strap 42 is beneficially attached to the ring 41 using common sewing techniques and can be fabricated from materials such as nylon, rubber, or the like. The strap 42 will typically measure approximately sixty (60) inches in length. A proximal portion of the strap 42 is formed into a loop 43 via sewing techniques and enables a grasping portion for the user 11. Beneficially the loop 43 comprises a diameter which measures approximately six (6) inches.

Figure 7:
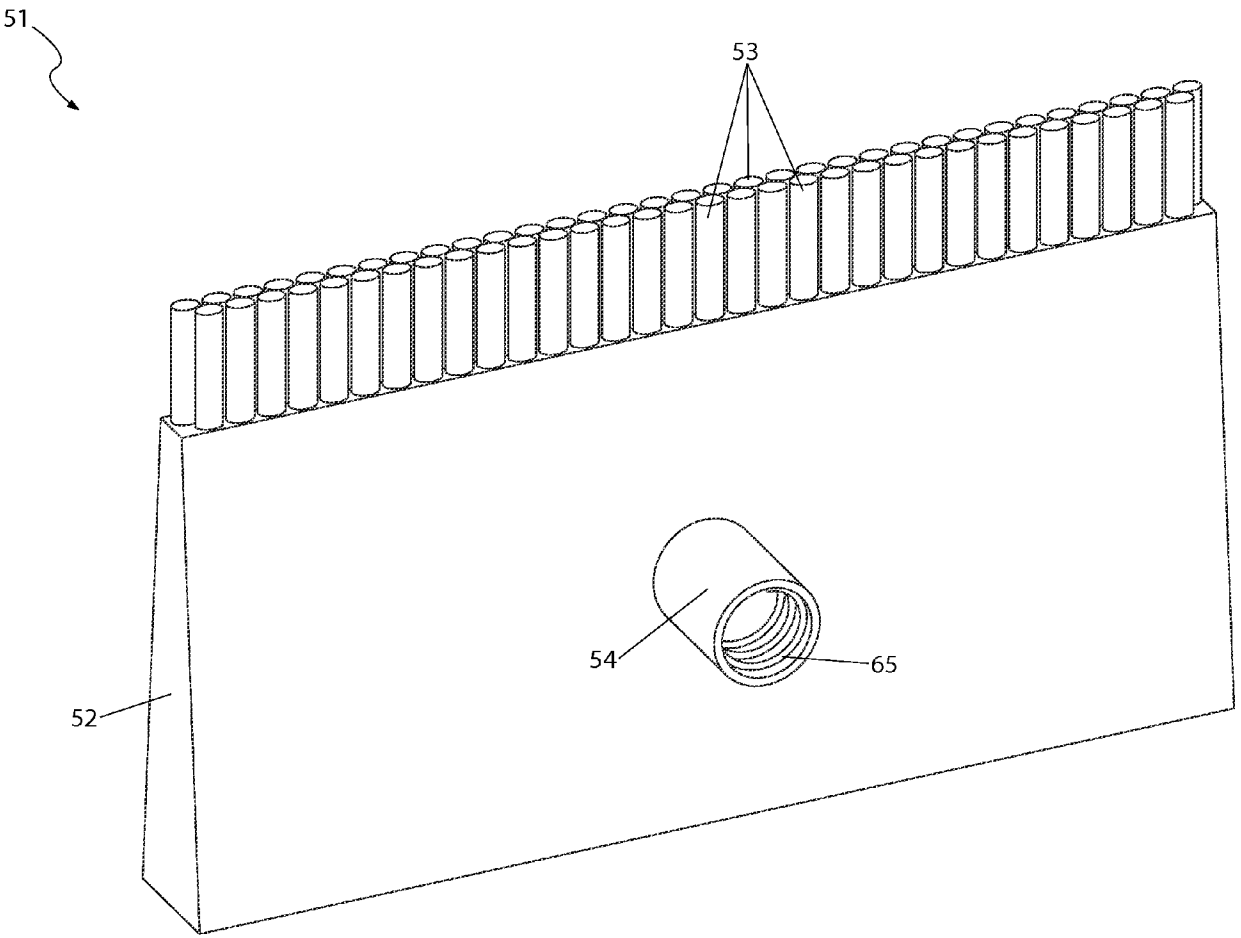
FIG. 7 is a front perspective view of a first attachment 51 suitable for use with the window maintenance device 10 illustrated in FIG. 1.
Figure 8:
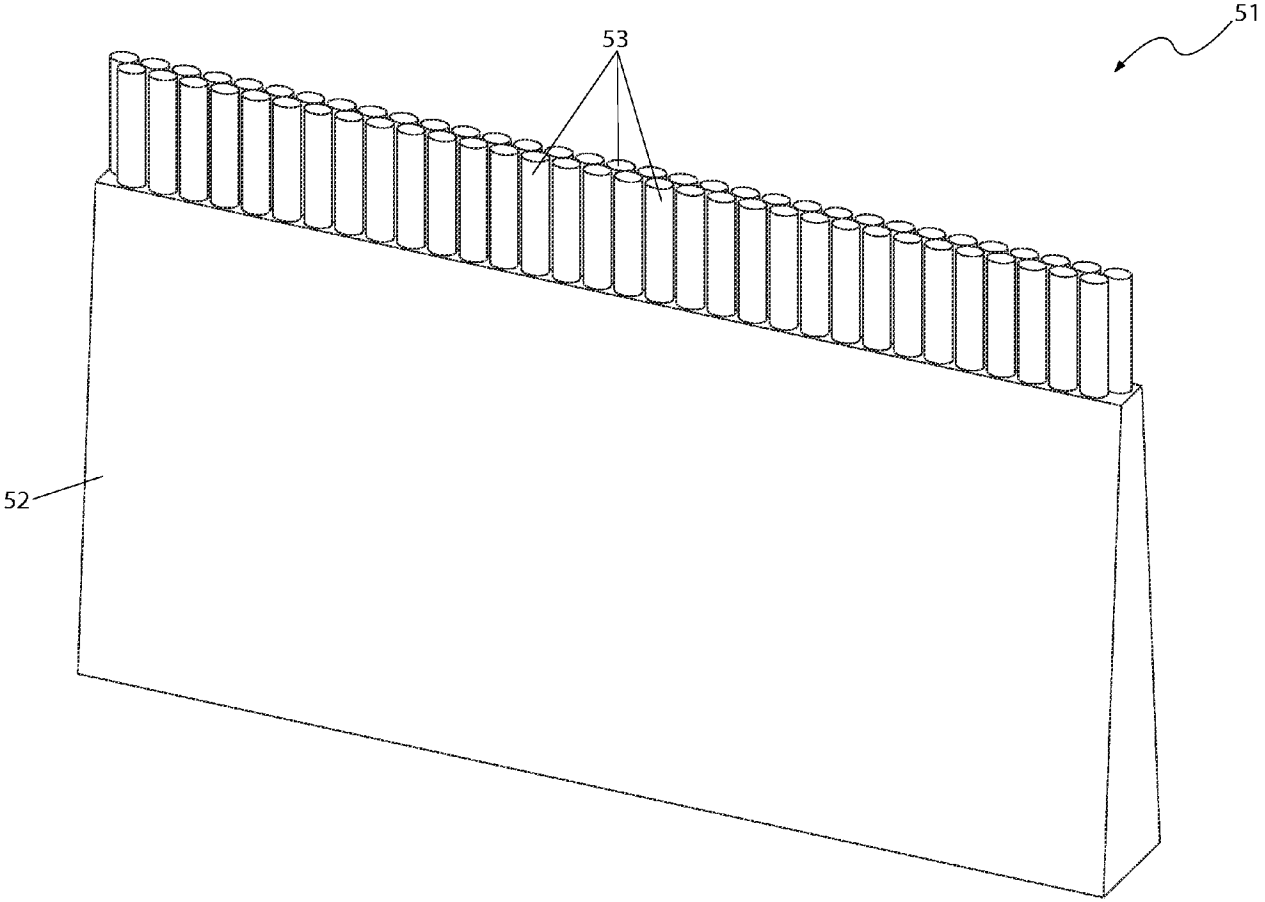
FIG. 8 is a rear perspective view of the first attachment 51 that is illustrated in FIG. 7.

Refer now to FIGS. 7 through 12 for various views of possible head attachments 50. As above-mentioned, the window maintenance device 10 may use a variety of head attachments 50 that provide the user 11 with various means of removing debris from the window of a large vehicle such as the tractor trailer 12 shown in FIG. 1. In particular, FIG. 7 depicts a front perspective view of a first attachment 51, FIG.

Figure 9:
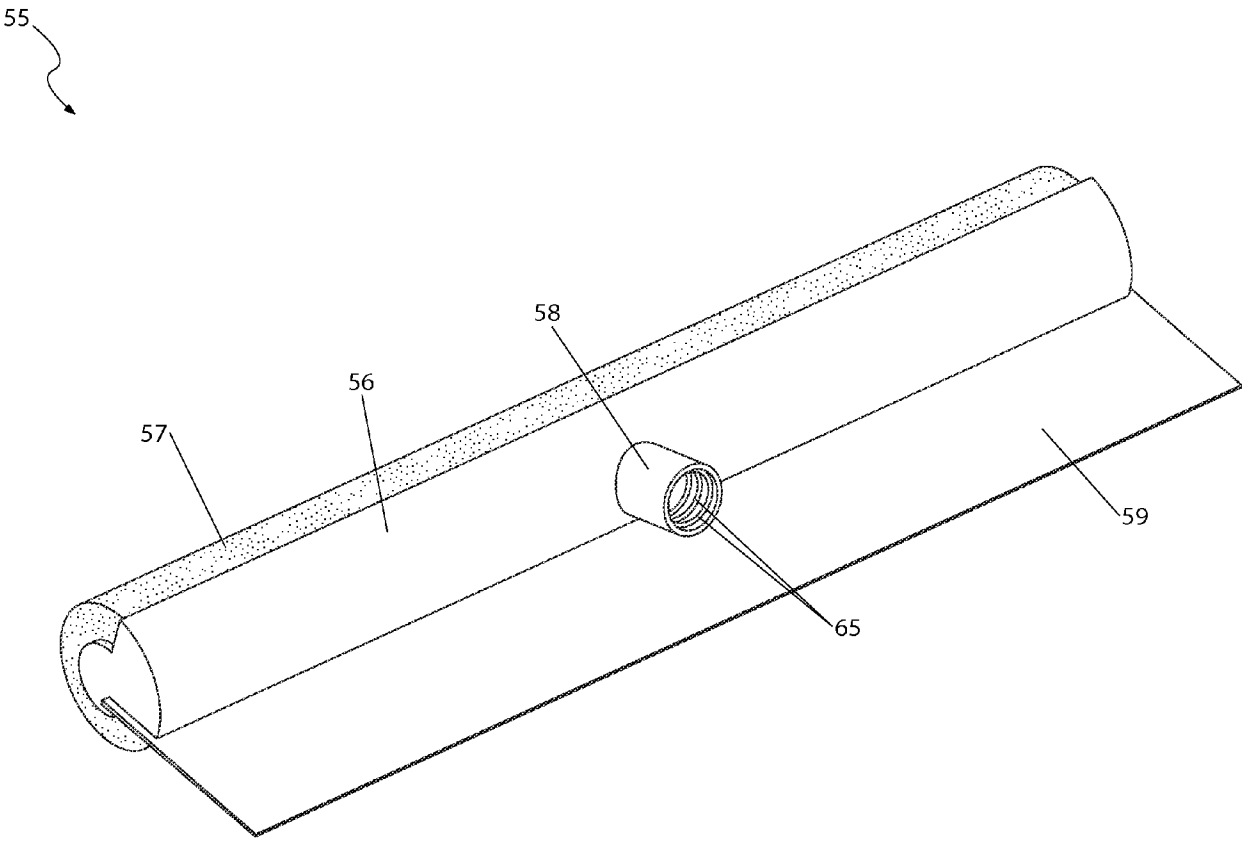
FIG. 9 is a front perspective view of a second attachment 55 suitable for use with the window maintenance device 10 illustrated in FIG. 1.
Figure 10:
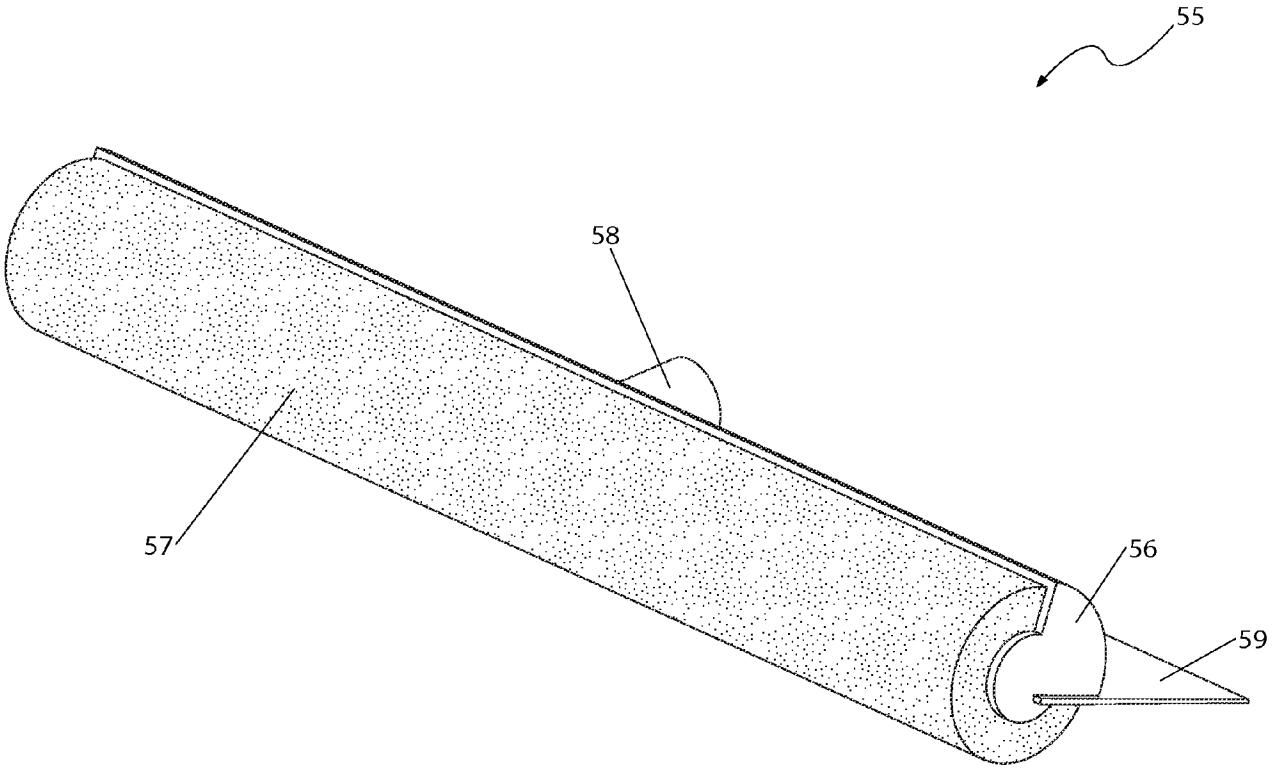
FIG. 10 is a rear perspective view of the second attachment 55 that is illustrated in FIG. 9.
Figure 11:
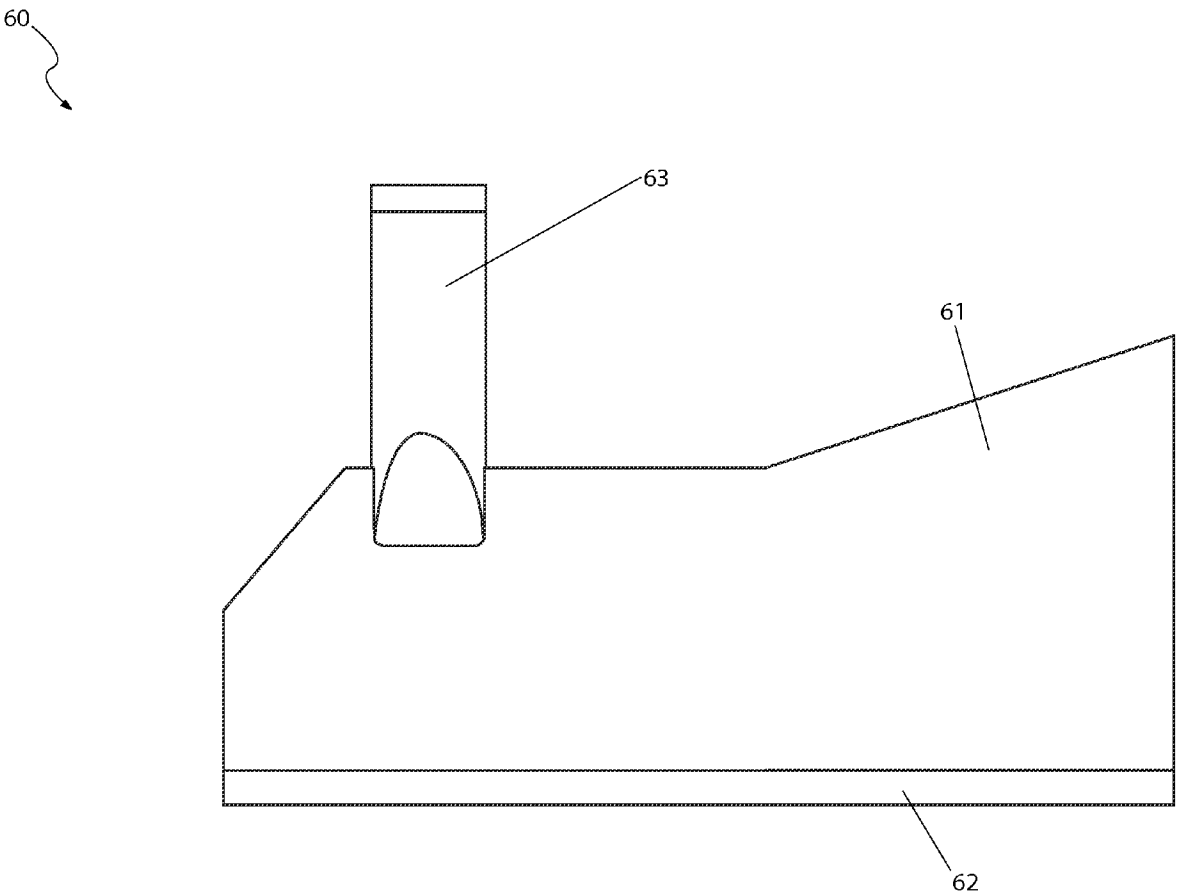
FIG. 11 is a front perspective view of a third attachment 60 suitable for use with the window maintenance device 10 illustrated in FIG. 1.
Figure 12:
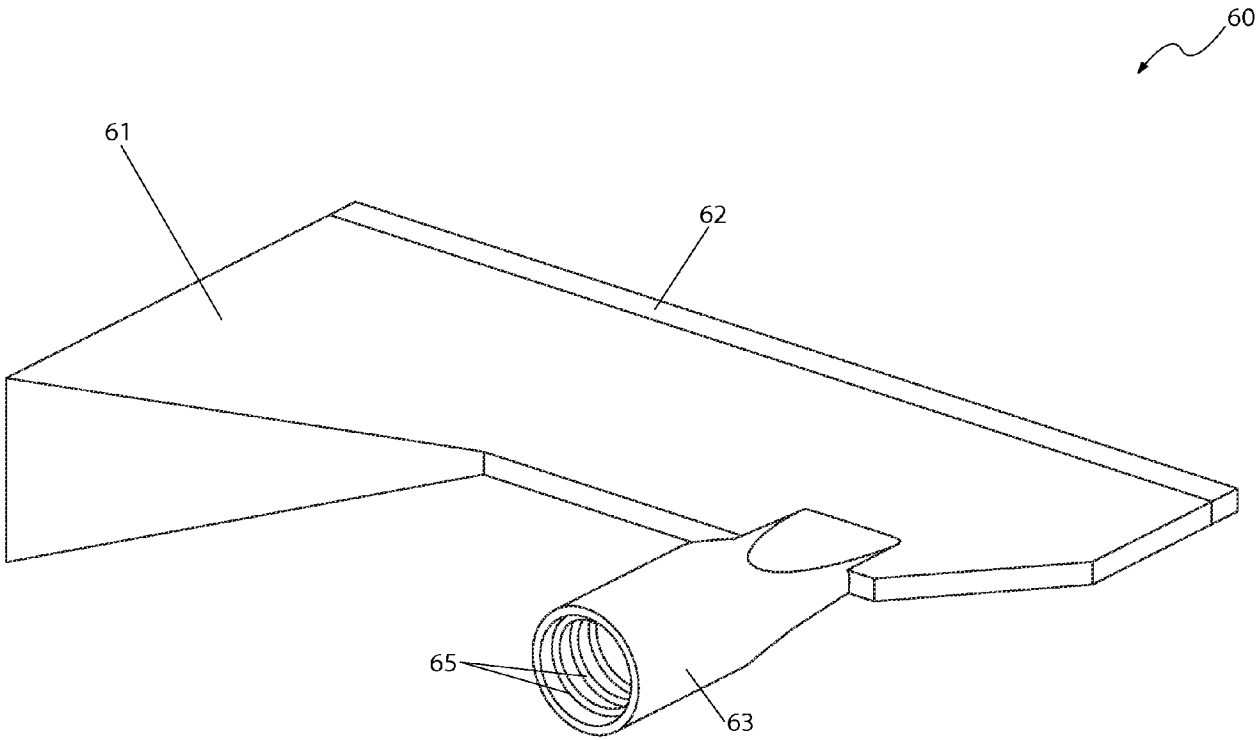
FIG. 12 is a rear perspective view of the third attachment 60 that is illustrated in FIG. 11; and, FIG. 13 is a perspective view of a storage bag 70 suitable for use with the window maintenance device 10 illustrated in FIG. 1, with the storage bag 70 depicted in an open state.

8 depicts a rear perspective view of the first attachment 51, FIG. 9 depicts a front perspective view of a second attachment 55, FIG. 10 depicts a rear perspective view of the second attachment 55, FIG. 11 depicts a front perspective view of a third attachment 60, and FIG. 12 depicts a rear perspective view of the third attachment 60. Each of the alternative head attachment 50 has an attachment threaded portion 65 which engages with the attachment extension threads 39 of the second attachment extension 36.

The first attachment 51 (FIGS. 7 and 8) comprises a triangular body 52 which is used to brush-away debris from the surface of the window of a vehicle (such as the tractor trailer 12). The first attachment 51 is preferably fabricated from plastic, rubber, stainless steel, or similar materials and beneficially is approximately thirteen (13) inches in length and five (5) inches in height. An upper perimeter edge of the triangular body 52 has a plurality of bristles 53 which are integrally molded to the triangular body 52. The bristles 53 will typically measure about two (2) inches in the upright direction and a half (½) inch in diameter. A side intermediate surface of the triangular body 52 comprises a first attachment extension member 54 which provides the attachment to the attachment extension threads 39. The first attachment extension member 54 is rod-shaped with an internally positioned attachment threaded portion 65. The first attachment extension member 54 is slightly smaller in diameter than the second attachment extension 36 to enable a threadable engagement.

The second attachment 55 (see FIGS. 9 and 10) has a cylindrical shape and is used for cleaning the window of a large vehicle such as the tractor trailer 12. The second attachment 55 has a pad body 57 which is preferably fabricated from a sponge material with a mesh overlay for scrubbing. The pad body 57 is attached via adhesive or is integrally molding to an attachment panel 56 which is preferably fabricated from plastic, rubber, stainless steel, or similar materials and provides an attachment to the second attachment extension member 58. The second attachment extension member 58 comprises a rod-shape which is slightly smaller in diameter than the second attachment extension 36 to enable a threadable engagement with the attachment extension threads 39. The second attachment extension member 58 has an internally positioned attachment threaded portion 65 that engages with the attachment extension threads 39. Opposing the lower perimeter edge of the pad body 57 and integrally molded to the attachment panel 56 is a squeegee 59. The squeegee 59 is utilized in a common manner and is preferably fabricated from rubber, yet other materials may be utilized.

The third attachment 60 (see FIGS. 11 and 12) generally has triangular scraper body 61 and is used to scrape ice or similar debris from the desired area of the window of a large vehicle, such as the tractor trailer 12 shown in FIG. 1. A widened portion of the scraper body 61 will preferably connect flush to a windshield during use which prevents the third attachment 60 from rolling over. The third attachment 60 can be rotated one-hundred-and-eighty (180°) degrees when in use to ensure the widened portion of the scraper body 61 is flush against the windshield. A lower perimeter edge of the scraper body 61 has a scraping blade 62 which engages the surface of the desired area for scraping. A third attachment extension member 63 is offset from the center of the scraper body 61 and comprises rod-shape which is slightly smaller in diameter than the second attachment extension 36 to enable a threadable engagement to the attachment extension threads 39. The third attachment 60 is preferably fabricated from a plastic, rubber, stainless steel, or similar materials.

Figure 13:
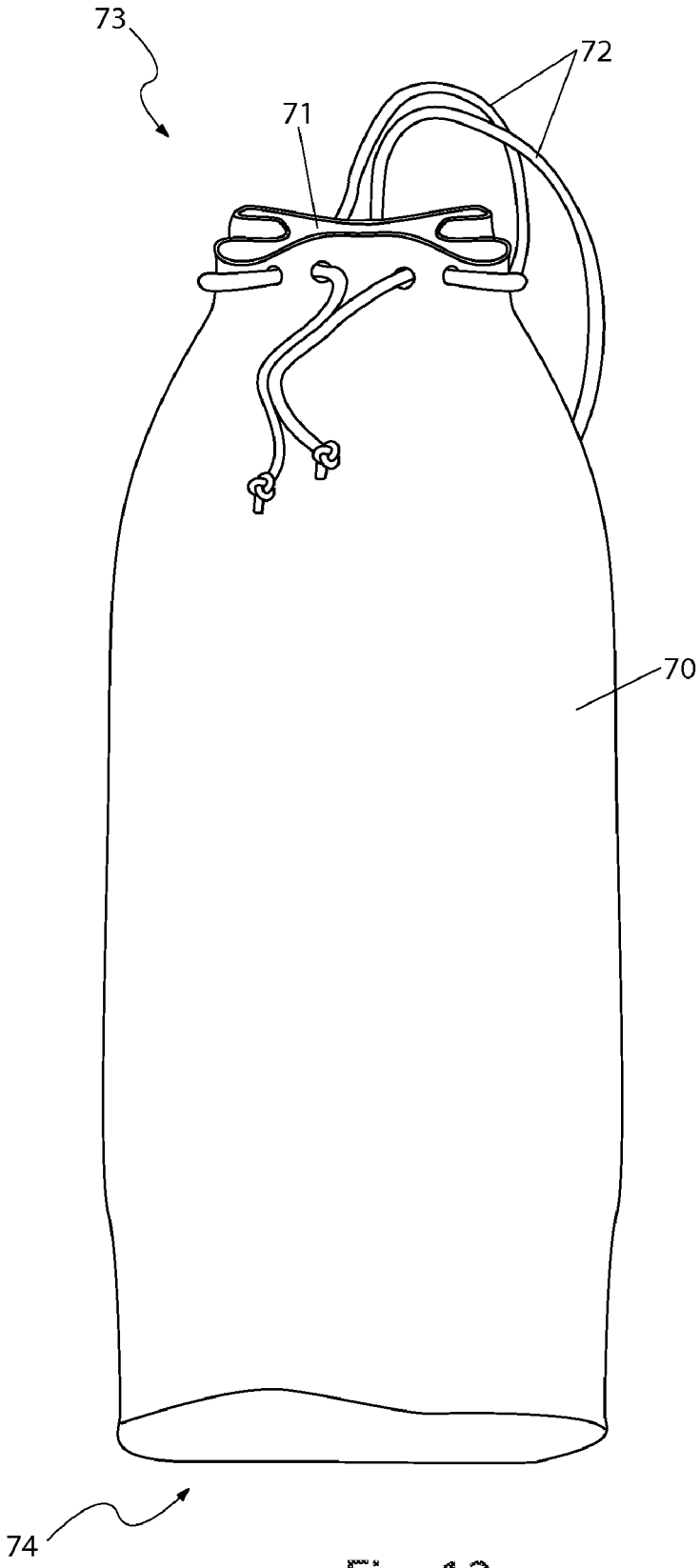

FIG. 13 shows a perspective view of a storage bag 70 in an open state. The storage bag 70 is used to store the window maintenance device 10 when the window maintenance device 10 is not in use. The storage bag 70 is beneficially nylon or vinyl and takes the form of a tubular structure having an open top 73 and a closed bottom 74. When a window maintenance device 10 is positioned inside an interior surface 71 it can be secured within the storage bag 70 via a drawstring 72 which closes the top 73 to prohibit the window maintenance device 10 from unintentional removal.

The method of installing and utilizing the window maintenance device 10 is performed by the following steps: grasping the pole assembly 20 by the handle grip 23; pivoting the pivoting member 26, 38 to a desired angle by rotating the extension fork 27, 37 about the axle 28 to orientate the first attachment extension 32 and the second attachment extension 36 to a desired angle; attaching a desired head attachment 50 onto the second attachment extension 36 via engaging the desired attachment threaded portion 65 with the attachment extension threads 39; utilizing the first attachment 51 to brush the tractor trailer 12, utilizing the second attachment 55 to wash or squeegee the tractor trailer 12, or utilizing the third attachment 60 to scrape the tractor trailer 12; extending the second handle extension 22 away from the first handle extension 21 as desired by engaging the handle extension detent pin 24 with the handle extension aperture 25; removing debris from the desired vehicle via the sliding or scraping the head attachment 50 onto said vehicle and grasping the loop 43 of the torque member 40 to provide additional torque while removing debris; and, removing of ice and snow from large vehicles in a manner which is quick, easy, and effective.

The method of installing and utilizing the storage bag 70 may be achieved by performing the following steps: acquiring the storage bag 70 placing the window maintenance device 10 within the interior surface 71; closing the top 73 with the drawstring 72 as desired; and, removing as necessary.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A window maintenance device, comprising:

an extendable and retractable telescoping pole assembly having a tubular first handle extension with an inner diameter and a plurality of handle extension apertures; said telescoping pole assembly further including a tubular second handle extension having an outer diameter that is slightly less than said inner diameter and which is partially located within said first handle extension, said second handle extension further having at least one detent pin on an exterior surface; wherein said at least one detent pin can engage with a selected handle extension aperture of said plurality of handle extension apertures to lock said second handle extension in position relative to said first handle extension;

an elongated first attachment extension;

a first pivoting member attached to a distal end of said second handle extension and to a proximal end of said first attachment extension, said first pivoting member configured such that said first attachment extension can pivot relative to said second handle extension, said first pivoting member further including a first locking mechanism to enable locking said first attachment extension at a desired angle relative to said second handle extension;

an elongated second attachment extension having both an attachment feature at a distal end and a ring stop;

a second pivoting member attached to a distal end of said first attachment extension and to a proximal end of said second attachment extension, said second pivoting member configured such that said second attachment extension can pivot relative to said first attachment extension, said second pivoting member further including a second locking mechanism to enable locking said second attachment extension at a desired angle relative to said first attachment extension; and, a torque member includes a ring at a distal end, said ring attached to said elongated second attachment extension;

wherein said torque member has a handle at a proximal end.

2. The window maintenance device according to claim 1, wherein said ring is held in place by said ring stop.

3. The window maintenance device according to claim 1, wherein said handle is a loop.

4. The window maintenance device according to claim 1, wherein said first pivoting member pivots over a range of approximately one-hundred-and-eighty (180°) degrees.

5. The window maintenance device according to claim 1, wherein said first locking mechanism enables locking at approximately five (5°) degrees, twenty (20°) degrees, and thirty (30°) degrees.

6. The window maintenance device according to claim 1, wherein said detent pin is spring loaded.

7. The window maintenance device according to claim 1, wherein a proximal exterior surface of said first handle extension comprises a slip-resistant grip.

8. The window maintenance device according to claim 1, wherein said first locking mechanism includes a handle extension fork, an attachment extension fork, and an axle which axially connects said handle extension fork and said attachment extension fork together.

9. The window maintenance device according to claim 8, wherein said handle extension fork includes a fork aperture that aligns with at least one position on said axle.

10. The window maintenance device according to claim 9, wherein said fork aperture has plurality of spaced fork protrusions that engage a plurality of axle protrusions.

11. The window maintenance device according to claim 1, wherein said attachment feature is a threaded shaft.

12. The window maintenance device according to claim 1, further including a head attachment connected to said attachment feature.

13. The window maintenance device according to claim 12, wherein said head attachment is a brush.

14. The window maintenance device according to claim 12, wherein said head attachment is an ice scraper.

15. The window maintenance device according to claim 12, wherein said head attachment is a squeegee.

16. The window maintenance device according to claim 1, further including a storage bag dimensioned to receive said telescoping pole assembly, said first attachment extension, said first pivoting member, said second attachment extension, said second pivoting member, and said torque member when said window maintenance device is collapsed.

* * * * *